United States Patent [19]

Wolowicz et al.

[11] Patent Number: 4,585,294

[45] Date of Patent: Apr. 29, 1986

[54] ACTIVE PIN CONTACT

[75] Inventors: James P. Wolowicz, Harrisburg; Howard R. Shaffer, Millersburg, both of Pa.

[73] Assignee: AMP Incorporated, Harrisburg, Pa.

[21] Appl. No.: 562,752

[22] Filed: Dec. 19, 1983

Related U.S. Application Data

[63] Continuation-in-part of Ser. No. 333,231, Dec. 21, 1981, Pat. No. 4,422,711.

[51] Int. Cl.[4] ..... H01R 11/22

[52] U.S. Cl. ..... 339/252 R

[58] Field of Search ..... 339/252 R, 252 P, 252 S, 339/217 J

[56] References Cited

U.S. PATENT DOCUMENTS

| | | | |
|---|---|---|---|
| Re. 26,721 | 11/1969 | Shlesinger, Jr. | 339/217 J |
| 1,387,252 | 8/1921 | Fredricks | 339/217 J |
| 2,690,546 | 4/1951 | Ostrak | 339/252 |
| 3,178,676 | 9/1962 | Antes | 339/252 |
| 3,358,265 | 12/1967 | Robards | 339/252 P |
| 3,617,991 | 7/1967 | Shlesinger, Jr. | 339/217 J |
| 3,766,516 | 10/1973 | Appleton | 339/252 P |

*Primary Examiner*—Gil Weidenfeld
*Assistant Examiner*—Paula Austin
*Attorney, Agent, or Firm*—Anton P. Ness

[57] ABSTRACT

An active electrical pin contact comprises a hollow contact having a longitudinal gap extending from one end to the other and having a pin contact section. A spring member is disposed and secured in the hollow contact and it includes a rear section, a bowed section, a short front section, and a long flexing section intermediate the rear section and the bowed section. The rear section and the short front section extend along inside surfaces of the hollow contact and the bowed section is disposed in the longitudinal gap including a contact-engaging section extending outwardly beyond an outside surface of the hollow pin contact section. The hollow contact also includes a relief section associated with the long flexing section of the spring member such that the spring member may flex within the relief section when an inward force is exerted on the contact-engaging section when the active pin contact is interconnected with a socket contact.

14 Claims, 5 Drawing Figures

ACTIVE PIN CONTACT

FIELD OF THE INVENTION

This is a continuation-in-part of application Ser. No. 333,231, filed Dec. 21, 1981, now U.S. Pat. No. 4,422,711. This invention relates to electrical contacts and more particularly to active pin contacts for electrical connection with socket contacts.

BACKGROUND OF THE INVENTION

Electrical connectors using matable pins and sockets have been extensively used. These electrical connectors are typically high density whereby a large number of matable pins and sockets are mounted in connector housings of the electrical connectors and electrical connection is effected by matable engagement between the pins and sockets and their respective housings. In this connection, the integrity of the electrical connection between the respective matable pins and sockets and the forces of insertion of the pins within the sockets during mating engagement are important factors to assure effective electrical connections. Use of active pin contacts can assure such effective electrical connections when matably connected with respective socket contacts.

SUMMARY OF THE INVENTION

According to the present invention, an active electrical pin contact comprises a hollow contact having a longitudinal gap extending from the rounded nose portion on the pin contact section at one end, to the conductor-connecting section at the other end. A spring member is disposed in the hollow contact and it includes a rear section, a bowed section, a short front section, and a long flexing section intermediate the rear section and the bowed section. The rear section and the short front section both extend along inside surfaces of the hollow contact opposite the longitudinal gap and the bowed section is disposed in the front of the longitudinal gap including a contact-engaging section extending outwardly beyond an outside surface of the hollow pin contact section. The hollow contact also includes an enlarged relief section intermediate the pin contact section and a rearward conductor-connection section associated with the long flexing section of the spring member such that the spring member may flex within the relief section when an inward force is exerted on the contact-engaging section when the active pin contact has been assembled into a contact-carrying housing assembly and is being interconnected with a socket contact in a socket contact housing assembly.

According to another aspect of the present invention, the rear section of the spring member is anchored against the inside surface of the spring engagement section of the hollow contact intermediate the relief section and the conductor-connecting section.

DETAILED DESCRIPTION OF PREFERRED EMBODIMENTS

Figure 1:
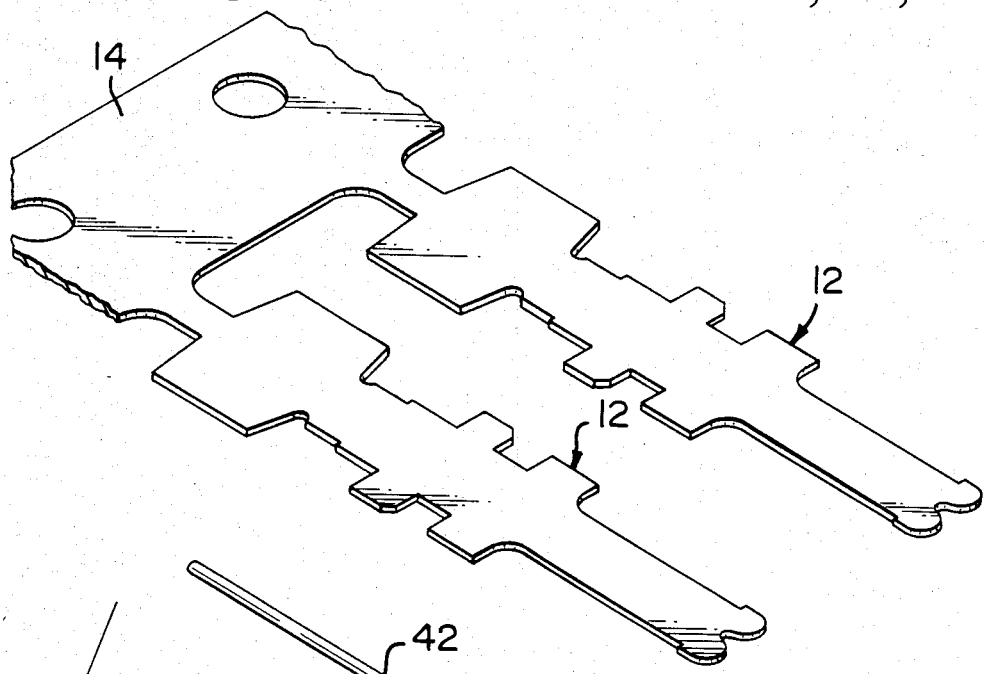
FIG. 1 is a perspective view of blanks of an active pin contact prior to being formed into active pin contacts.
Figure 2:
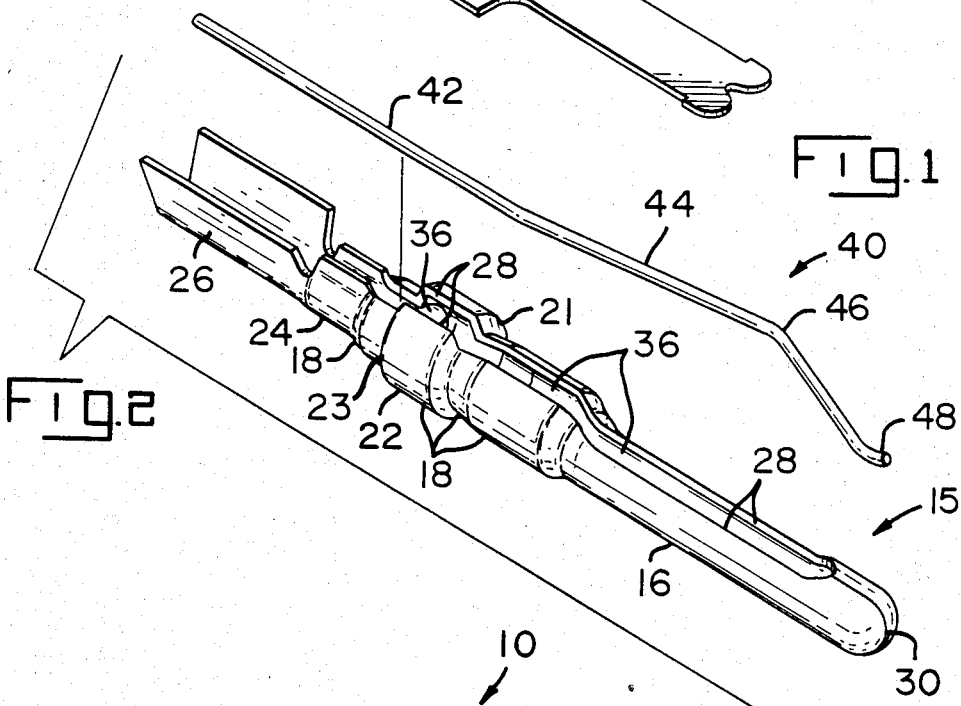
FIG. 2 is a perspective view of a formed active pin contact with a spring member exploded therefrom.

FIG. 1 illustrates blanks 12 on carrier strip 14 which have been stamped from a suitable metal strip such as brass or the like. Blanks 12 outline the pin contact prior to being formed as illustrated in FIG. 2 wherein the hollow contact 15 includes a pin contact section 16, a relief section 18, a stop section 22 within relief section 18, a spring-engagement section 24 and a conductor-connecting section. Edges 28 of hollow contact 15 are spaced from each other as illustrated in FIG. 2 thereby forming a longitudinal gap 36 extending from the rounded nose portion 30, along pin contact section 16, along relief section 18 and stop section 22, and along spring engagement section 24. Stop section 22 has a forward stop surface 21 and a rearward stop surface 23.

After blanks 12 have been formed into hollow pin contacts 15 as shown in FIG. 2 and with the formed hollow contacts 15 still connected to carrier strip 14, they are preferably nickel underplated and then gold plated.

A spring member 40 is formed from beryllium copper wire or like metal and includes a rear section 42, a long flexing section 44, a bowed section 46, and a short front section 48. Rear section 42 is preferably linear.

Figure 3:
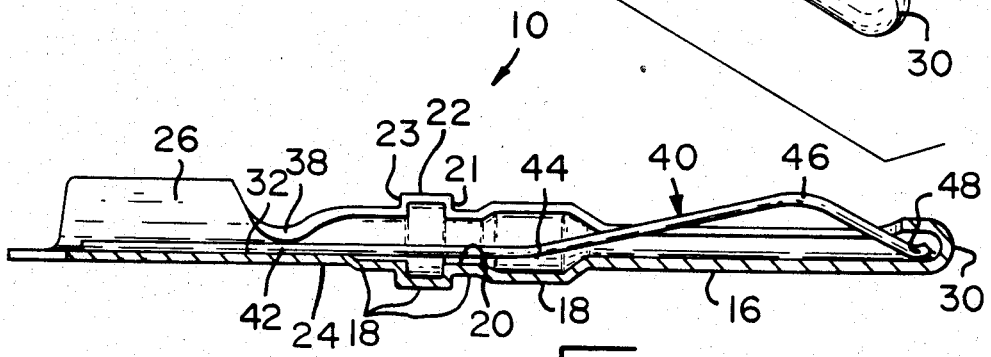
FIG. 3 is a cross-sectional view showing a completely-formed active pin contact with a spring member secured in place therein.
Figure 4:
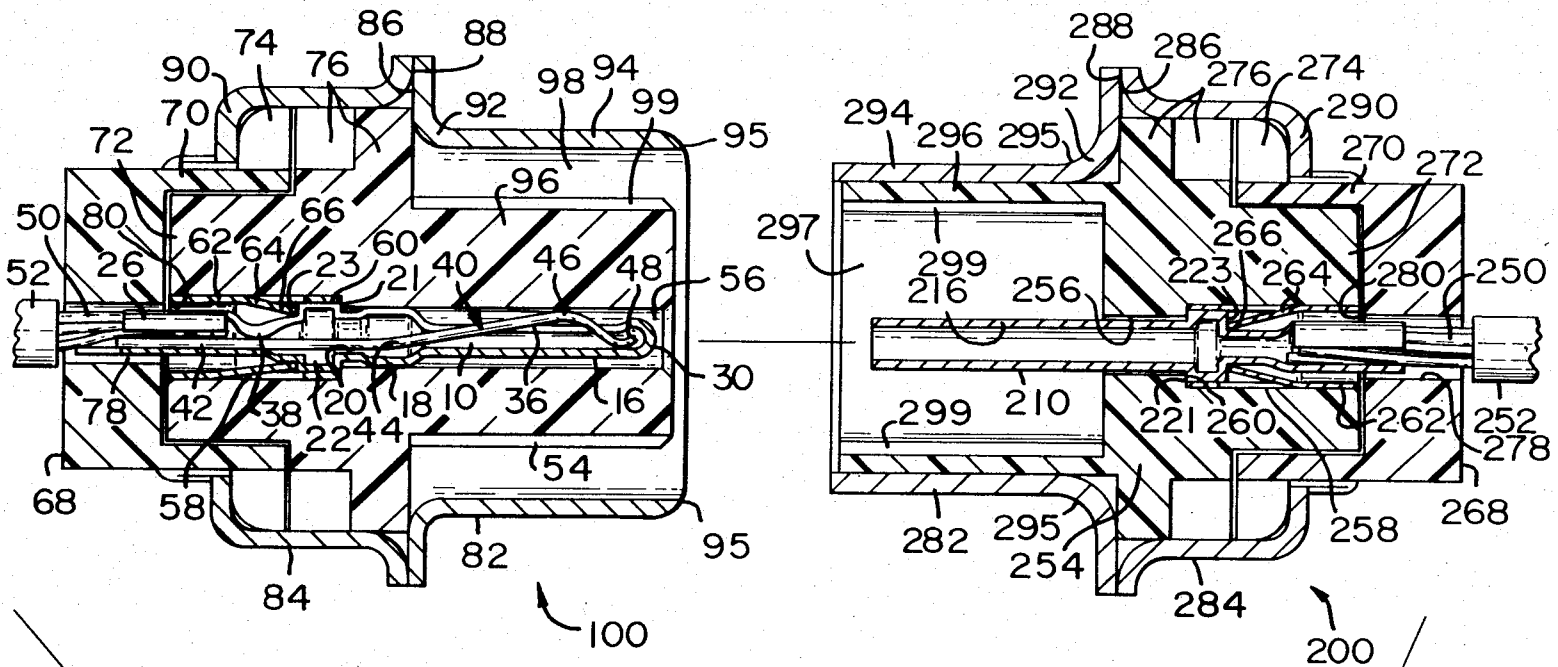
FIG. 4 is a cross-sectional view of matable electrical connector housings, terminated pin and socket contacts therein, and metal shells therearound.
Figure 5:
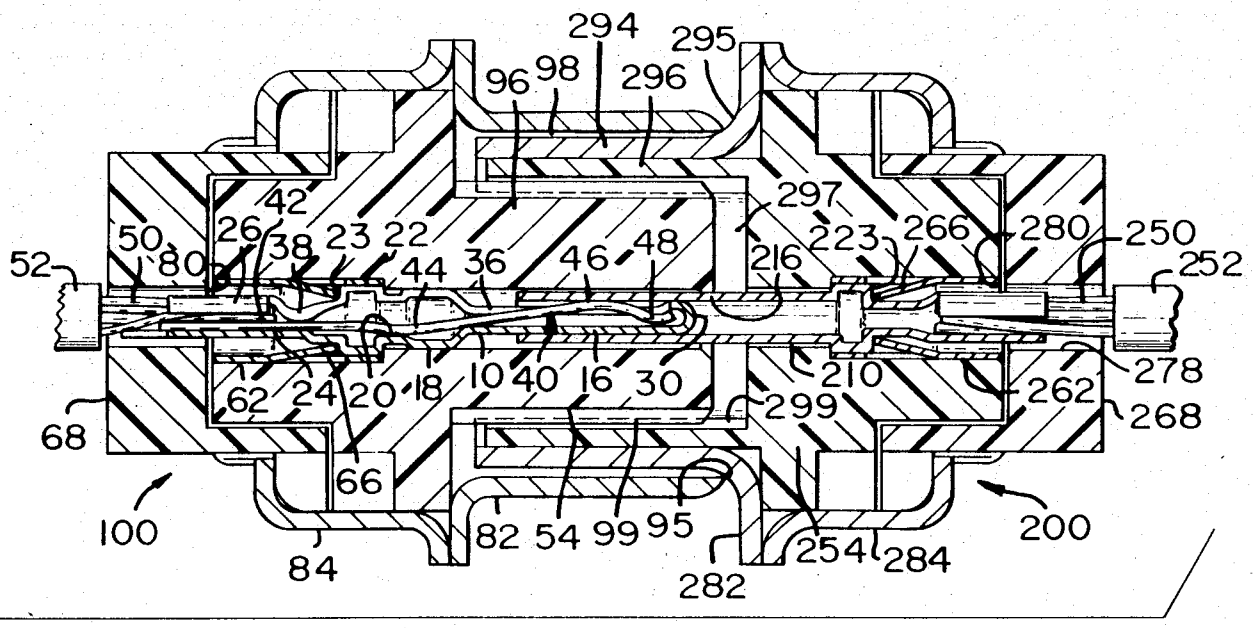
FIG. 5 is a view similar to FIG. 4 showing the connector housings and pin and socket contacts in mated engagement.

As shown in FIG. 2, hollow contact 15 is formed with edges 28 spaced from each other to form a longitudinal gap 36 slightly wider than spring member 40 to enable spring member 40 either to be inserted therethrough along the length of hollow contact 15 or, more preferably for efficiency in manufacturing to be inserted axially from rearward the hollow contact 15 such that short front section 48 of the spring member 40 may slide along the inside surface of hollow contact 15 towards and into the nose portion 30, and bowed section 46 follows partially extending outwardly beyond the outer surface of the hollow contact 15 through the longitudinal gap 36. It is preferred that a pinch crimp 38 be formed along spring-engagememt section 24 and toward the rear thereof as shown in FIGS. 3-5 by pinching together the two sides of spring engagement section 24 above rear section 42 of spring member 40 and firmly therearound thereby anchoring rear section 42 of spring member 40 against the inside surface 32 of spring-engagement section 24. This anchoring assists during and after manufacturing by preventing spring member 40 from inadvertently becoming dislodged from hollow contact 15. With spring member 40 anchored in position in spring-engagement section 24, bowed section 46 of spring member 40 is disposed within longitudinal gap 36 near the front thereof and a part of bowed section 46 extends outwardly beyond the outer surface of pin contact section 16 thereby defining a contact-engaging section.

After inserting and anchoring spring member 40 into hollow contact 15 creating active pin contact 10 as illustrated in FIG. 3, conductor 50 of insulated electrical conductor 52 is terminated in conductor-connecting section 26; the particular open-barrel configuration of conductor-connecting section 26 of active pin contact 10 as illustrated allows for a conventional "F" crimp, which is described more particularly in U.S. Pat. No. 2,600,012.

After termination, the active pin contact 10 will be assembled in a pin terminal housing assembly 100, as shown in FIG. 4. This pin terminal housing assembly 100 will then be mated or interconnected with a corresponding socket terminal housing assembly 200 to form a mated connection, all as is described more completely hereinbelow. During this mating process an inside surface of a corresponding socket contact 210 will slide over, and exert an inward force onto, the contact-engaging section of bowed section 46 of spring member 40, which will flex the long flexing section 44 of spring member 40. It is preferred that the contact-engaging section of bowed section 46 of spring member 40 be substantially forward in pin contact section 16, so that electrical contact with socket contact 210 occurs early in the mating process.

In the preferred embodiment of the invention, relief section 18 of active pin contact 10 is circumferential around active pin contact 10 (except at longitudinal gap 36) and has a general outer diameter greater than the outer diameter of pin contact section 16 and of spring-engagement section 24 thereby defining a general inside surface (including that portion of the inside surface of the contact 10 towards which the spring member's long flexing section 44 flexes) which is farther from the central axis of the active pin contact 10 than inside surface 32 of spring-engagement section 24. Stop section 22, located within relief section 18, has an outer diameter still greater than the general outer diameter of relief section 18. A relief engagement surface 20 may be located within relief section 18 approximately one-third the distance from the forward end of spring engagement section 24 of active pin contact 10 to the bowed section 46 of the spring member 40. This relief engagement surface 20 may be closer to the axis of active pin contact 10 than the general inside surface of the relief section 18 but to prevent interference with the flexing of spring member 40, should be farther from the axis than the inner surface of pin contact section 16 and especially farther than inside surface 32 of spring contact section 24 on the side of active pin contact 10 towards which long flexing section 44 of spring member 40 flexes (opposite longitudinal gap 36). Thus relief engagement surface 20 would be the first surface, if any, contacted by the long flexing section 44 of spring member 40 when it is flexed by reason of the inward force applied to bowed section 46 by socket contact 210 in socket terminal housing assembly 200 when pin terminal housing assembly 100 is interconnected therewith as hereinbelow described. Between relief engagement surface 20 and pin contact section 16 a portion of relief section 18 would allow additional flexing of spring member 40 forward of that location where contacting would first occur between relief engagement surface 20 and long flexing section 44 of spring member 40.

It is also preferred that short front section 48 of spring member 40 be curved in a direction reverse to that of bowed section 46: it assists in insertion of spring member 40 into the formed hollow contact 15 by allowing ease of sliding along the inside surface of the contact; it allows a smoother fit of the front of spring member 40 in the nose portion 30 of pin contact 16 after insertion which is of value when the terminated active pin contact 10 has been assembled into pin terminal housing assembly 100 and is being interconnected with socket terminal housing assembly 200 as hereinbelow described.

As shown in FIG. 4 active pin contact 10 has already been terminated to conductor 50 of insulated electrical conductor 52 and inserted into pin terminal housing assembly 100. A dielectric contact-carrying member 54 has a cavity 56 into which terminated active pin contact 10 will be inserted. Cavity 56 has a rearward enlarged section 58, and a stop surface 60 which will engage forward stop surface 21 of active pin contact 10 to limit progressive movement during insertion. Disposed circumferentially within enlarged section 58 and extending completely therealong is a conventional metal spring clip 62 having a plurality of circumferentially spaced barbs 64 which extend forwardly and are normally spring biased towards the axis of cavity 56. The forward ends 66 of barbs 64 will engage rearward stop surface 23 of active pin contact 10 after insertion to limit any rearward movement of active pin contact 10 after insertion, and during insertion of active pin contact 10 the barbs 64 are easily spread outwardly by active pin contact 10. A dielectric rear housing member 68 has a hood section 70 extending forwardly to envelope rear section 72 of contact-carrying member 54 and has a shoulder 74 which butts against shoulder 76 of contact-carrying member 54. Rear housing member 68 has a cavity 78 which corresponds to cavity 56 of contact-carrying member 54 and is axially aligned therewith, and cavity 78 has a diameter less than that of enlarged section 58 of cavity 56 but greater than that of any part of active pin contact 10. At the forward end of cavity 78 is a stop surface 80 to prevent rearward movement of spring clip 62.

Both dielectric contact-carrying member 54 and dielectric rear housing member 68 can be made from a suitable insulating material such as plastic, and can be rectangular or circular in shape and have a plurality of cavities 56 arranged generally in rows, to carry a plurality of active pin contacts 10. Shoulders 76 and 74 extend adjacent each other around the perimeter of contact-carrying member 54 and rear housing member 68 respectively. The contact-carrying member 54 and rear housing member 68 are secured together by a forward metal shell portion 82 and a rear metal shell portion 84 which shell portions are firmly secured together about their abutting perimeters such as by a plurality of metal tabs (not shown) on the edge 86 of forward shell portion 82 bent over an abutting edge 88 of rear shell portion 84 (or vice versa) around the perimeter. Rear metal shell portion 84 has a perimeter overlap 90 which firmly engages the rear surface of shoulder 74 of rear housing member 68. Forward metal shell portion 82 has a perimeter shoulder 92 which firmly engages the front surface of shoulder 76 of contact-carrying member 54. Forward hood section 94 of forward metal shell portion 82 extends forward to front edge 95 from perimeter shoulder 92 parallel to the plug portion 96 of contact-carrying member 54 and is spaced a distance therefrom to provide a perimeter gap 98 therebetween.

Terminated active pin contacts 10 are simply inserted into corresponding cavities 78 from the rear surface of rear housing member 68 which has already been secured to contact-carrying member 54 by means of forward and rear metal shell portions 82 and 84, and which assembly already contains metal spring clips 62 disposed within enlarged sections 58 of cavities 56. When forward stop surfaces 21 of active pin contacts 10 engage stop surfaces 60 at the forward ends of enlarged sections 58 of cavities 56, forward ends 66 of barbs 64 of metal spring clips 62 will have attained their normal bias towards the axis of cavities 56 and be ready to stoppingly engage rearward stop surfaces 23 of active pin contacts 10 should rearward movement of active pin contacts 10 be urged. Pin contact sections 16 of active pin contacts 10 are now fully disposed within those portions of cavities 56 contained within plug portion 96 of contact-carrying member 54. In the particular contact-carrying assembly hereinabove described no adhesive material or potting compound was needed.

As shown in FIG. 4 a socket contact 210 (stamped and formed similarly to hollow contact 15 and from similar materials) has already been terminated to a conductor 250 of an insulated electrical conductor 252 and inserted into a socket terminal housing assembly 200. Socket contact 210 preferably has a barrel-shaped section 216 at the front thereof which is circumferentially continuous at least at the top thereof; if a seam exists in socket contact 210 it should be closed to prevent a gap at the point of contact with contact engaging section of active pin contact 10. A dielectric socket-carrying member 254 has a cavity 256 into which terminated socket contact 210 is inserted. Cavity 256 has a rearward enlarged section 258, and a stop surface 260 which engages forward stop surface 221 of socket contact 210 to limit progressive movement during insertion. Disposed circumferentially within enlarged section 258 and extending completely therealong is a conventional metal spring clip 262 having a plurality of circumferentially spaced barbs 264 which extend forwardly and are normally spring biased towards the axis of cavity 256. The forward ends 266 of barbs 264 engage rearward stop surface 223 of socket contact 210 to limit any rearward movement of socket contact 210 after insertion, and during insertion of socket contact 210 the barbs 264 are easily spread outwardly by socket contact 210. A dielectric rear socket housing member 268 has a hood section 270 extending forwardly to envelope rear section 272 of socket-carrying member 254 and has a shoulder 274 which butts against shoulder 276 of socket-carrying member 254. Rear socket housing member 268 has a cavity 278 which corresponds to cavity 256 of socket-carrying member 254 and is axially aligned therewith, and cavity 278 has a diameter less than that of enlarged section 258 of cavity 256 but greater than that of any part of socket contact 10. At the forward end of cavity 278 is a stop surface 280 to prevent rearward movement of spring clip 262.

Housing socket portion 296 of socket-carrying member 254 defines a large cavity 297 surrounding barrel-shaped sections 216 of socket contacts 210 having such dimensions and a configuration that plug portion 96 of contact-carrying member 54 is insertable therein and substantially fills large cavity 297, as shown in FIG. 5. Similarly, barrel-shaped sections 216 of socket contacts 210 have configurations selected such that they are insertable in cavities 56 of contact-carrying member 54 and just over pin contact sections 16 of active pin contacts 10 but have a length dimension such that they do not extend to relief sections 18 or stop surfaces 21 of active pin contacts 10 when fully mated.

Both dielectric socket-carrying member 254 and dielectric rear socket housing member 268 can be made from a suitable insulating material such as plastic, and have configurations corresponding to pin terminal housing assembly 100 and have a plurality of cavities 256 corresponding to cavities 56 of pin terminal housing assembly 100 to carry a plurality of socket contacts 210. Shoulders 276 and 274 extend adjacent each other around the perimeter of socket-carrying member 254 and and rear housing member 268 respectively. The socket-carrying member 254 and rear socket housing member 268 are secured together by a forward metal shell portion 282 and a rear metal shell portion 284 which shell portions are firmly secured together about their abutting perimeters such as by a plurality of metal tabs (not shown) on the edge 286 of forward shell portion 282 bent over an abutting edge 288 of rear shell portion 284 (or vice versa) around the perimeter. Rear metal shell portion 284 has a perimeter overlap 290 which firmly engages the rear surface of shoulder 274 of rear socket housing member 268. Forward metal shell portion 282 has a perimeter shoulder 292 which firmly engages the front surface of shoulder 276 of socket-carrying member 254. Forward hood section 294 of forward metal shell portion 282 extends forward from perimeter shoulder 292 parallel and adjacent to the housing socket portion 296 of socket-carrying member 254.

When both pin terminal housing assembly 100 and socket terminal housing assembly 200 have been assembled, they are matably interconnected as illustrated in FIG. 5; housing socket portion 296 of socket-carrying member 254 with adjacent forward hood section 294 of forward metal shell portion 282 first enters perimeter gap 98 between plug portion 96 of contact-carrying member 54 and forward hood section 94 of forward metal shell portion 82; barrel-shaped sections 216 of socket contacts 210 are aligned with cavities 56 of plug portion 96 and enter therein, enveloping active pin contacts 10 beginning at the rounded nose portions 30 thereof. Progressive interconnection movement of the housing assemblies is stopped and full mating achieved when front edge 95 of forward metal shell portion 82 is stoppingly engaged by surface 295 of perimeter shoulder 292 of forward metal shell portion 282. Keying ridges 99 are provided on the outer surface of plug portion 96 of contact-carrying member 54 to engage with keying channels 299 inside and along housing socket 296 of socket-carrying member 254 to provide a guide and polarizing means when the housing members are being matably interconnected. Pin contact sections 16 are now electrically connected within barrel-shaped sections 216 of socket contacts 210. When full mating has been achieved, the collective spring forces exerted by the spring members 40 on socket terminals 210 tend to firmly maintain the assemblies in mated position. Other connecting means such as clamps or bolts could be optionally added to hold the metal shells together after interconnection. Also extensions of edges 86, 88, 286 and 288 or one or more thereof may be provided to allow for fastening to bulkheads.

As illustrated in FIG. 5, the interconnection of pin contact section 16 with barrel-shaped section 216 of socket contact 210 causes the contact-engaging section of bowed section 46 of spring member 40 to be engaged by an inside surface of barrel-shaped section 216 of socket contact 210 which causes pin contact section 16 to wipingly move along socket contact 210 by virtue of the spring force exerted by spring member 40. The corresponding inward force applied to bowed section 46 by socket contact 210 causes long flexing section 44 of spring member 40 to flex downward toward and into the relief area provided by relief section 18 of the hollow contact. Since the inner surface of this portion of the active pin contact 10 is farther from the central axis of the contact than inside surface 32 of spring-engagement section 24 which is engaged by rear section 42 of spring member 40, substantial flexing is permitted. Rear section 42 is secured against inside surface 32 by pinch crimp 38 and is further secured by being terminated with electrical conductor 50 and then crimped in conductor-connecting section 26 of active pin contact 10. It is believed that, while preferred, such securing need not absolutely prevent axial movement of rear section 42 of spring member 40 for the operation of the present invention. Similarly, some axial movement may allowably occur by short front section 48 of spring member 40 along the inside surface of pin contact section 16 until short front section 48 becomes snugly lodged inside nose portion 30, and thus it is preferable that the short front section 48 be shaped to conform to the inside surface of the pin contact section 16 at nose portion 30.

The insertion forces can be rather significant as the density of the active pin contacts 10 and socket contacts 210 increase in a connector. The configuration of spring members 40 and the operational characteristics thereof enable pin contact sections 16 to electrically engage socket contacts 210 in an effective manner and the insertion forces are reduced when interconnection takes place. Particularly, the long flexing section 44 of spring member 40 reduces localized stress of spring member 40 and thereby enhances the long-term effective life of active pin contact 10.

We claim:

1. An active electrical pin contact comprising a hollow contact and a spring member secured in said hollow contact, characterized in that:

said hollow contact includes a pin contact section, a conductor-connecting section for electrical connection with an electrical conductor, a spring-engagement section forward from said conductor-connecting section and a relief section intermediate said pin contact section and said spring-engagement section, said hollow contact being formed with a rounded nose portion in said pin contact section;

said spring member has a rear section, a bowed section, a short front section, and a long flexing section intermediate said rear section and said bowed section which has a curved configuration reverse to that of said bowed section;

said spring member is inserted into said hollow contact and secured therein with said rear section extending along an inside surface of said spring-engagement section of said hollow contact, said bowed section having a contact-engaging section extending through a longitudinal gap in said pin contact section and above an outside surface thereof, said short front section extending along an inside surface of said nose portion, and said long flexing section disposed along said relief section of said hollow contact proximate an inside surface of said relief section; and one of said long flexing section and said relief section is adapted to provide radial spacing between said long flexing section and said inner surface of said relief section when said spring member is unstressed, whereby said long flexing section is flexible toward said inner surface when an inward force is exerted onto said contact-engaging section of said spring member.

2. An active electrical pin contact as set forth in claim 1 characterized in that said short front section of said spring member has a curved configuration reverse to that of said bowed section.

3. An active electrical pin contact as set forth in claim 1 characterized in that a pinch crimp is formed rearwardly of said relief section of said hollow contact securing said rear section of said spring member in position against said inside surface of said spring-engagement section of said hollow contact.

4. An active electrical pin contact as set forth in claim 1 characterized in that said hollow contact includes a stop section rearward of said pin contact section, said stop section having a stop surface to engage a contact-carrying member to limit progressive movement of said hollow contact upon insertion of said hollow contact into said contact-carrying member, the outer diameter of said stop section being greater than the outer extent of said relief section.

5. An active electrical pin contact as set forth in claim 1 characterized in that said relief section is circumferential about said hollow contact.

6. An active electrical pin contact as set forth in claim 1 further characterized in that said hollow contact has longitudinally extending edges spaced a predetermined distance from each other and including said longitudinal gap along said pin contact section.

7. An active electrical pin contact as set forth in claim 1 characterized in that said rear section of said spring member is axially movable along said inside surface of said spring-engagement section of said hollow contact.

8. An active electrical pin contact as set forth in claim 7 characterized in that said relief section has a general inside surface towards which said long flexing section of said spring member flexes which is farther from the central axis of said hollow contact than said inside surface of said spring-engagement section of said hollow contact.

9. An active electrical pin contact as set forth in claim 8 characterized in that said relief section has a relief engagement surface closer to said central axis of said hollow contact than said general inside surface of said relief section, which relief engagement surface first engages said long flexing section of said spring member during flexing thereof and a portion of said relief section extends forward of said relief engagement surface thereby permitting additional flexing by said long flexing section forward thereof.

10. An active electrical pin contact as set forth in claim 1 characterized in that said rear section is fixedly secured along said inside surface of said spring-engagement section of said hollow contact.

11. An active electrical pin contact as set forth in claim 10 characterized in that said relief section has a general inside surface towards which said long flexing section of said spring member flexes which is farther from the central axis of said hollow contact than said inside surface of said spring engagement section of said hollow contact.

12. An active electrical pin contact as set forth in claim 11 characterized in that said relief section has a relief engagement surface closer to said central axis of said hollow contact than said general inside surface of said relief section, which relief engagement surface first engages said long flexing section of said spring member during flexing thereof and a portion of said relief section extends forward of said relief engagement surface thereby permitting additional flexing by said long flexing section forward thereof.

13. An active electrical pin contact as set forth in claim 1 characterized in that said rear section of said spring member is fixedly secured along said inside surface of said spring-engagement section of said hollow contact, said relief section is circumferential about said hollow contact having a diameter greater than the diameter of said spring-engagement section and said pin contact section, and said hollow contact includes a stop section circumferential thereabout having a diameter greater than said diameter of said relief section, said stop section having a stop surface to engage a contact-carrying member to limit progressive movement of said hollow contact upon insertion of said hollow contact into said contact-carrying member, said stop section located rearward of said pin contact section.

14. An active electrical pin contact as set forth in claim 13 characterized in that said stop section is located within said relief section.

* * * * *